United States Patent [19]

Donovan

[11] 4,166,332

[45] Sep. 4, 1979

[54] PORTABLE DISPLAY APPARATUS

[75] Inventor: John E. Donovan, Skokie, Ill.

[73] Assignee: Package Exhibit Programs, Inc., Niles, Ill.

[21] Appl. No.: 807,979

[22] Filed: Jun. 20, 1977

Related U.S. Application Data

[63] Continuation-in-part of Ser. No. 688,821, Jun. 1, 1976, Pat. No. 4,030,219.

[51] Int. Cl.[2] ..... G09F 13/00

[52] U.S. Cl. ..... 40/605; 40/606; 160/135; 211/195

[58] Field of Search ..... 40/605, 606, 611, 152, 40/152.1; 160/135, 351; 52/285, 584, 586; 211/198, 195, 189

[56] References Cited

U.S. PATENT DOCUMENTS

| | | | |
|---|---|---|---|
| 3,460,282 | 8/1969 | Swirsky | 40/152 X |
| 3,466,777 | 9/1969 | Wistrand et al. | 40/605 |
| 3,565,152 | 2/1971 | Cohn et al. | 40/605 X |
| 3,817,396 | 6/1974 | Markson | 40/605 |
| 3,852,901 | 12/1974 | Woodle et al. | 40/605 |

*Primary Examiner*—John F. Pitrelli

[57] ABSTRACT

A portable display apparatus is herein disclosed. The portable display apparatus is composed of a plurality of rectangular skeletal frames. Each rectangular skeletal frame of the plurality includes a horizontal hinge adapted to enable vertical members of the frame to fold vertically. Each of the vertical members has a connector portion and a pair of track portions. Each of the vertical rectangular skeletal frames is adapted to be connected to a dovetail slide connector to other rectangular skeletal frames. The dual track portions are adapted to receive a pair of display panels. The dual track portions are positioned so that connector portions of the dovetail connectors do not interfere with the track portions or display panels.

6 Claims, 5 Drawing Figures

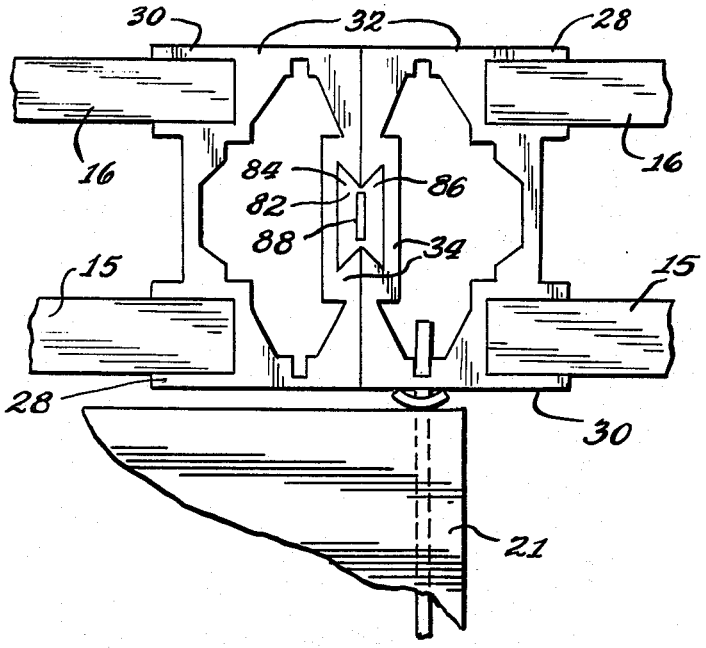
Fig. 3.
Fig. 4.
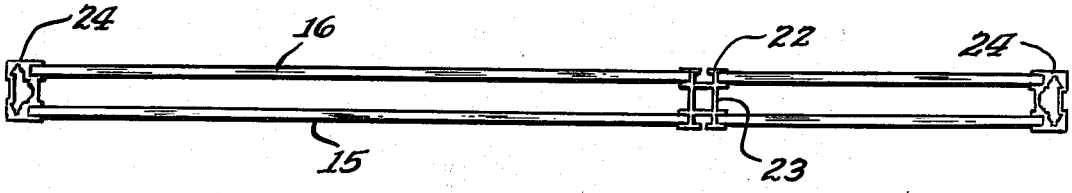
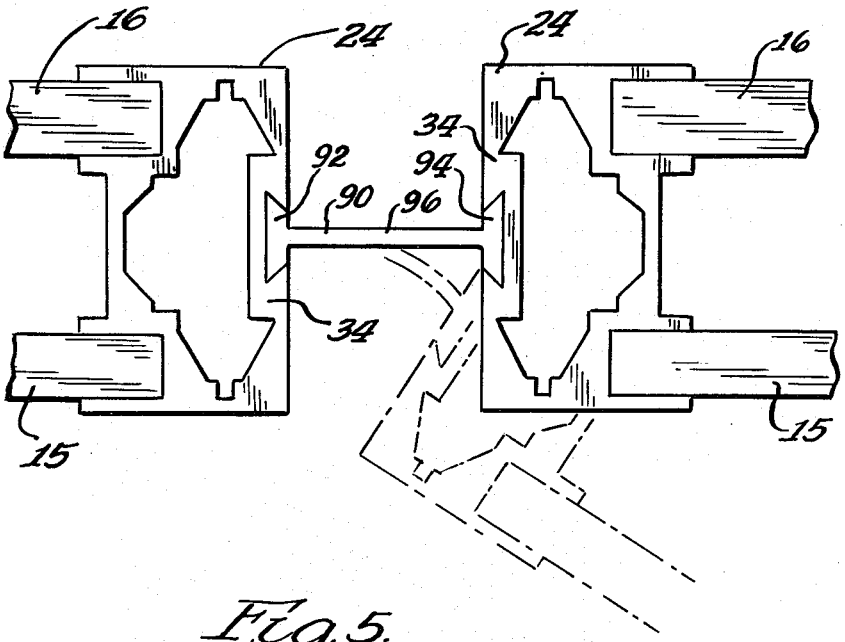
Fig. 5.

PORTABLE DISPLAY APPARATUS

CROSS-REFERENCE TO RELATED APPLICATION

This case is a continuation-in-part application, the parent case of which is entitled PORTABLE DISPLAY APPARATUS, Ser. No. 688,821, filed June 1, 1976, which is now U.S. Pat. No. 4,030,219.

BACKGROUND OF THE INVENTION

A portable display apparatus, per se, is a device which is old in the art. The portable display apparatus is convenient for quickly and easily transporting and setting up exhibits at a convention or display site. The portable display apparatus usually consists of a framework which is adapted to receive a plurality of panels. The panels have information upon them which is to be communicated by the exhibitor to the persons during the exhibit.

Older models of the typical display apparatus are often assembled with display units positioned in a single plane. This constraint on assembly, of course, limits the most efficient utilization of limited exhibit space. Furthermore, if a conventional display apparatus was to be assembled with a frame member at right angles to one of the frame members, it was difficult to connect the two frame members together without having to disturb one or more of the display panels held within the frame.

Therefore, what is needed is a portable display apparatus having a plurality of display frames which can be connected together to assume a variety of fixed angular displacements from each other. What is also needed is a combination right angle and parallel connector which is adapted to connect adjacent display frames together without the necessity of interference with two display panels carried in the display frames.

SUMMARY OF THE INVENTION

A portable display apparatus, consisting of a plurality of connected rectangular skeletal display frames is disclosed herein. Each of the rectangular skeletal display frames has a central hinge allowing an upper portion of the display frame to be folded into contact with a lower portion of the display frame. The upper portion and the lower portion are identical rectangles. When thus folded together, the display frames present a compact configuration which may be easily shipped and stored in a minimum amount of space. Each of the display frames also has a plurality of uprights which have dual track portions and a central connector portion formed integral therewith. The dual track portions receive a pair of display panels slideably. Each of the track portions is approximately $\frac{3}{8}$ inch in width and is adapted to receive a $\frac{3}{8}$ inch thick display panel. If thinner display panels are desired to be used, a panel stop may be rested on top of a lower panel to prevent an upper panel from sliding into contact with the lower panel. The connector portions which are formed integral with the dual track portions, are offset from the track portions to allow the frames to be connected together without interfering with the panels within the tracks. Each of the connector portions has a one-half dovetail section which is adapted to receive an elongated plastic dovetail to join the connector portions together. A return frame upright has a square center section having four tracks formed integral with the center section. The return frame is also dovetailed.

In use, the portable display apparatus is carried in a folded configuration within a single trunk. The trunk is approximately five feet high and two feet wide. Upon arrival at an exhibit site, the display frames are removed from the trunk, unfolded and connected together via the connector portions and dovetails. After the display frames are set up, a plurality of display panels are inserted into the track portions of the lower parts of the display frames. A panel stop is rested on top of each of the lower display panels. Upper display panels are then inserted into panel tracks in the upper portions of the display frames and rested on the panel stops. The panel stops prevent the upper panels from sliding into the panel tracks together with the lower panels. The extension arms of the light fixtures are inserted into the connector portions of selected uprights of the skeletal frame immediately adjacent the track portions.

It is a principal object of the present invention to provide a portable display apparatus having a plurality of upright connectors which are connectable together in a variety of fashions without interfering with track portions of the upright connectors.

It is another object of the instant invention to provide a portable display apparatus having a plurality of upright connectors which are extruded from anodized aluminum.

Other objects and uses of the present invention will become obvious to one skilled in the art upon a perusal of the following specification and claims in light of the accompanying drawings.

BRIEF DESCRIPTION OF THE DRAWINGS

FIG. 3 is a top view of a pair of dovetailed connectors of the assembled display apparatus of FIG. 1;

FIG. 4 is a top view of a single frame unit of FIG. 1, having a central return frame upright; and FIG. 5 is a top view of a pair of dual track uprights connected together by an enlongated flexible dovetail.

DESCRIPTION OF THE PREFERRED EMBODIMENT

Figure 1:
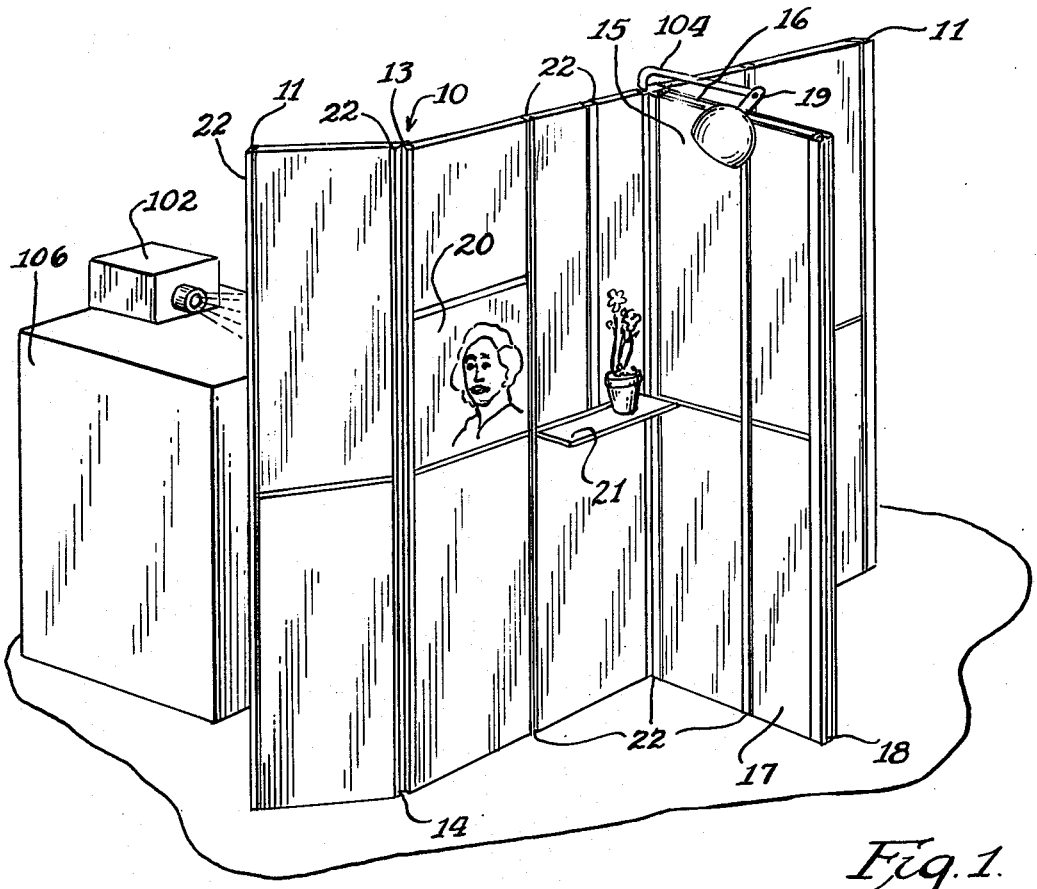
FIG. 1 is a perspective view of an assembled display apparatus embodying the instant invention.

Referring now to the drawings, and especially to FIG. 1, a portable display apparatus generally embodying the present invention and indicated by numeral 10 is shown therein. Portable display apparatus 10 includes a plurality of articulated rectangular skeletal frames 11. Articulated skeletal frame 11 includes an upper rectangular skeleton 13 and a lower rectangular skeleton 14. Upper rectangular skeleton 13 and lower rectangular skeleton 14 are hingedly connected together. An upper display panel 15 and an upper display panel 16 are slideably mounted within upper rectangular skeleton 13. A lower display panel 17 and a lower display panel 18 are slideably mounted in lower rectangular skeleton 14. A spot lamp 19 is connected to one of frames 11. A view screen 20 is slideably mounted within one of frames 11. A shelf 21 is mounted on one of frames 11. Skeletal frames 11 have a plurality of uprights 22.

Figure 2:
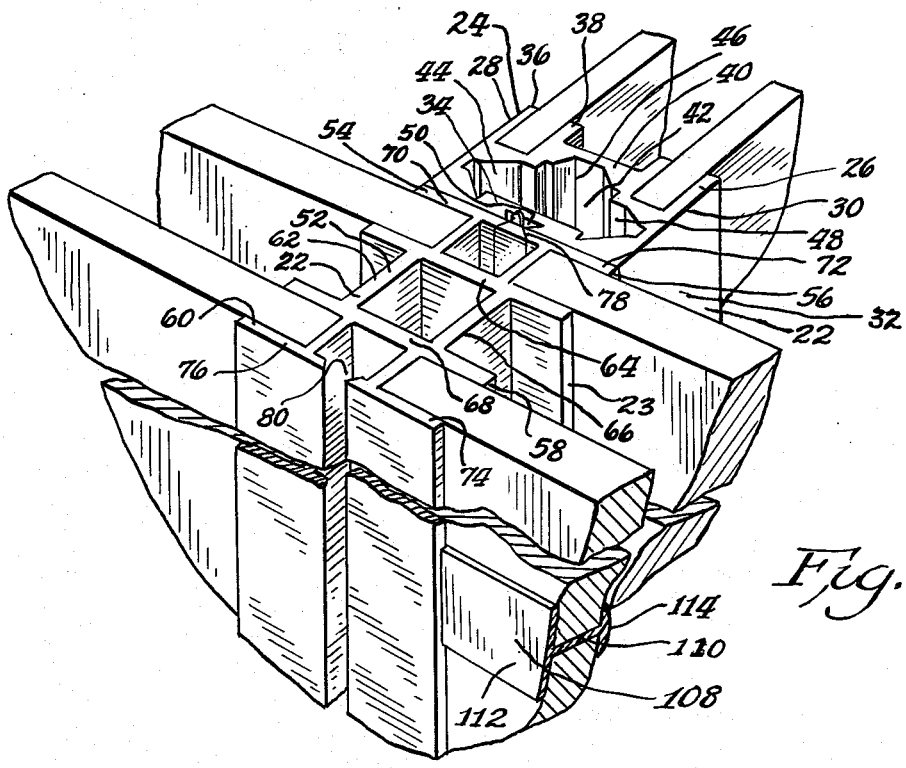
FIG. 2 is a perspective view, having a portion broken away, of an enlarged portion of a return frame upright dovetailed to another upright of the display apparatus of FIG. 1, having a lamp removed for purposes of clarity.

Referring now to FIG. 2, a perspective view of a section of the skeletal frame uprights is shown therein. It should be noted that the uprights 22 of the articulated skeletal frame 11 include a return frame bar upright 23 and a dual track upright 24. The dual track upright 24 will be examined in detail first.

Referring now to FIGS. 2 and 3, details of the dual track upright 24 can be seen therein. The dual track upright includes a pair of tracks respectively numbered 28 and 30. Each of the tracks is formed integral with a support portion 32. A connector portion 34 is formed integral with support portion 32.

Taking track 28 as the exemplary track, track 28 has an exterior track wall 36 and an interior track wall 38. Track walls 36 and 38 are parallel and are separated by a distance of ⅜ of an inch. Track wall 36 extends along a width of the support portion 32 of upright 24 and is formed integral with and perpendicular to connector portion 34. Track 30 is identical to track 28. Tracks 28 and 30 are separated by a spacer wall 40 which is formed integral with and perpendicular to tracks 28 and 30, respectively. Wall 40 defines a portion of a polygonal cavity 42. Polygonal cavity 42 has a first substantially triangular section 44, a second substantially triangular section 46 and a third substantially triangular section 48. Connector portion 34 also defines a part of polygonal opening 42. Connector portion 34 has a dovetail joint 50 formed therein. Dovetail joint 50 is adapted to receive a plastic dovetail material. Upright 24 is composed of extruded anodized aluminum.

Return frame bar 23 has a central square support section 52. Return frame bar 23 also has a first track 54, a second track 56, a third track 58 and a fourth track 60.

Central square support section 52 has a first wall 62, a second wall 64, a third wall 66 and a fourth wall 68. Track 54 has an exterior wall 70. Track 56 has an exterior wall 72. Track 58 has an exterior wall 74 and track 60 has an exterior wall 76. Track portions 54 and 60 are parallel and formed perpendicular to wall 62 of square box 52. Tracks 56 and 58 are parallel and are parallel to tracks 54 and 60. Tracks 56 and 58 are perpendicular to wall 66 of support portion 52. Exterior walls 70 and 72 of tracks 54 and 56, respectively, are beveled and define a dovetail slot 78. In a similar fashion, walls 74 and 76 of tracks 58 and 60 are also beveled and define a dovetail slot 80. Dovetailed slots 78 and 80 are adapted to receive an elongated plastic dovetail.

Tracks 54, 56, 58 and 60 are each ⅜ of an inch wide and are adapted to receive each a separate display panel. It should also be noted that walls 70 and 72 are collinear walls, as are walls 74 and 76.

An elongated double plastic dovetail 82 having a first dovetail ear 84 and a second dovetail ear 86 formed integral with first dovetail ear 84 is used to join adjacent uprights together. Dovetail 82 is composed of polyethylene which is self-lubricating. Dovetail 82 has an upper grip portion 88 which may be grasped to remove dovetail 82 from engagement with uprights to which it is inserted.

Another embodiment of the dovetail is shown in FIG. 5. In this case, an elongated plastic double dovetail 90 having a first dovetail side 92 and a second dovetail side 94 joined by an elongated neck 96 is shown therein. Neck 96 is substantially longer than a width of either dovetail ears 92 or 94. Neck 96 is flexible any may be used to set up adjacent uprights at a variety of angles while still allowing the adjacent uprights to be joined together.

Adjacent uprights, such as upright 24 having only dual tracks, may be joined end-to-end as is shown in FIG. 3. While this configuration allows straight line, or collinear display panelling to be set up, the return frame upright 23 allows a T panel to be set up in which connector 34 is butted up against exterior walls 70 and 72 of a return frame connector as is shown in FIG. 2. Likewise, a second dual track upright 24 could be dovetailed to walls 74 and 76 of return frame 23 to form an X configuration, although this is not shown in FIG. 2. It should be noted that frames employing the return frame upright as shown in FIG. 4, use the return frame upright as a central connector. In addition, the return frame upright is asymmetrically spaced from its end frames. A usual spacing is that the return frame connector is a unit distance from a first dual track upright and the return frame is twice the unit distance from a second dual track upright which is positioned opposite the first dual track upright. This asymmetric positioning allows for superior stability when the portable display apparatus 10 is assembled. It should be noted that the use of the plastic double dovetail sections 82 or 90 allows dual panel display frames to be connected together without the necessity of the fasteners interfering with the display panels set within the display frames. In addition, the double dovetails provide locking alignment between neighboring uprights even if extruding idiosyncracies render the neighboring uprights slightly asymmetric.

Although a hinged display apparatus has been disclosed herein, a non-hinged display apparatus having elongated panels extending from the top of the display apparatus to the bottom can also be employed. This type of display apparatus can be used not only for display, but can also be used as portions of a wall partition for offices and factories and the like. The uprights of the portable display apparatus are disassembled by merely grasping tab 88 and drawing the dovetail out of the connector portions 34 or past the wall portions 70 and 72 of the dual track upright 24 and the return frame upright 23, respectively.

As is disclosed in the co-pending case, Ser. No. 688,821, U.S. Pat. No. 4,030,219 portable display apparatus 10 also includes a shelf 21 which can be hung from the uprights. A film display screen 20 can be inserted under a relatively short panel and a rear projector 102 can project a still or motion picture on film screen 20. Likewise, a lamp can be fitted into aperture 42 of the upright 24 to illuminate the display apparatus. The display apparatus is portable when knocked down and can be carried in a compact trunk 106. Compact trunk 106 is also used to support projector 102 to project a picture on screen 20. If panels having less than a width of ⅜ inch are employed in the present invention, there is a danger that upper panels will slide past lower panels. A panel stop 108 having a horizontal stop portion 110 and a pair of vertical retaining walls respectively numbered 112 and 114 is rested across the upper portion of the lower display panel and receive the upper display panel to prevent the upper display panel from sliding past the lower display panel.

It should therefore be appreciated that the upright constructions disclosed herein allow quick and easy assembly of a portable display apparatus having dual track portions which receive front and rear facing display panels without the necessity of fasteners interfering with the display panels themselves. In addition, the setup of the portable display apparatus requires a minimum of tools, since the connectors merely have to be inserted into the dovetail slots to hold the portable display apparatus together. Similarly, the portable display apparatus, through its use of four track return frames and two track uprights allows a variety of geometric shapes to be used in which both sides of a display panel can display useful information.

Although a specific embodiment of the instant invention has been described in detail above, modifications and changes of the instant invention will be obvious to one skilled in the art. It is to be expressly understood that the instant invention is limited in scope only by the appended claims.

What is claimed is:

1. In a portable display apparatus for use in exhibitions, shows and the like, said display apparatus having a plurality of pairs of parallel elongated uprights connected to each other, and a pair of parallel display panels slidably mounted between each of said pair of parallel uprights, the improvement being wherein: each upright of a selected pair of parallel uprights is an extruded section having an elongated central support portion, each central support portion having four sides, a pair of parallel tracks formed integral with one side of each of the central support portions and being coextensive therewith, each track in each pair of parallel tracks being open in the same direction as the other track of that pair, each of said parallel tracks extending toward the opposite parallel track of the other upright of the pair of uprights, each of said pairs of opposed tracks removably and slidably receiving one of the pair of parallel display panels, a second pair of parallel tracks formed integral with the side of each central support portion opposite the one side, each track in each second pair of parallel tracks being open in the same direction as the other track of that pair, each of said tracks of each second pair of tracks being open in the direction opposite to the direction in which the first mentioned pair of parallel tracks on the respective central support portion is open, each of said tracks of each of said second pair of parallel tracks slidably and removably receiving a display panel of another pair of parallel display panels, and a third side of each of the central support portions having a face parallel to the first mentioned parallel display panels, each said third side having a slot between a pair of oppositely facing tracks, including, a dual track elongated upright being an extruded section, said dual track upright including, an elongated support portion, a pair of parallel tracks formed integral with one side of the support portion, each track of said pair of parallel tracks formed integral with the support portion being open in the same direction as the other track of that pair, each of said tracks formed integral with the support portion slidably and removably receiving one of a pair of parallel dual track display panels, a connector portion formed integral with the support portion on the side opposite the side having the pair of parallel tracks, said connector portion having a slot; and a connector mounted in the slot of the connector portion and in the slot of the central support portion of an upright to link that upright to the dual track upright.

2. In a portable display apparatus for use in exhibitions, shows and the like as defined in claim 1, wherein one of said display panels is positioned between a pair of opposed tracks; and including, a second display panel positioned between the same pair of opposed tracks above said one of said display panels, and a panel stop positioned between said display panels between the same pair of opposed tracks, said panel stop having a stop portion positioned between said display panels between the same pair of opposed tracks, a first retaining wall formed integral with one edge of the stop portion, and a second retaining wall formed integral with an opposed edge of the stop portion, adjacent edges of the display panels between said pair of opposed tracks being positioned between the first and the second retaining walls.

3. In a portable display apparatus for use in exhibitions, shows and the like as defined in claim 1 including, a carrying container in which the portable display apparatus is transported, and a projection screen mounted between a second pair of selected parallel uprights at a height approximately level with the height of an image projected from a projector positioned on top of the carrying container.

4. In a portable display apparatus for use in exhibitions, shows and the like as defined in claim 1, wherein, said connector is an elongated plastic extruded section having one side being a dovetail slidably mounted in the slot of the connector portion and an integral opposite side being a dovetail mounted in the slot of the central support portion.

5. In a portable display apparatus for use in exhibitions, shows and the like as defined in claim 1, wherein, said connector is an elongated plastic extruded section having one elongated side being a dovetail slidably mounted in the slot of the connector portion, an opposite elongated side being a dovetail slidably mounted in the slot of the central support portion, and an elongated flexible neck having one edge formed integral with the one side and an opposite edge formed integral with the opposite side for joining the side and the opposite side.

6. In a portable display apparatus for use in exhibitions, shows and the like as defined in claim 1 wherein, each parallel upright and each dual track upright is aluminum having its respective surface anodized.

* * * * *